United States Patent [19]

Wessel

[11] 4,130,328

[45] Dec. 19, 1978

[54] MULTI LEVEL PROGRAMMING ASSEMBLY

[75] Inventor: Kenneth Wessel, White Plains, N.Y.

[73] Assignee: Sealectro Corporation, Mamaroneck, N.Y.

[21] Appl. No.: 863,895

[22] Filed: Dec. 23, 1977

[51] Int. Cl.[2] ..... H01R 29/00

[52] U.S. Cl. ..... 339/18 C; 339/182 R; 339/252 P

[58] Field of Search ..... 339/17 M, 17 LM, 18 R, 339/18 B, 18 C, 18 P, 176 R, 176 P, 176 S, 182 R, 183, 208, 252 P

[56] References Cited

U.S. PATENT DOCUMENTS

| | | | |
|---|---|---|---|
| 3,284,757 | 11/1966 | Krone | 339/252 P |
| 3,335,388 | 8/1967 | Karol | 339/18 B |

FOREIGN PATENT DOCUMENTS

| | | | |
|---|---|---|---|
| 1017429 | 1/1966 | United Kingdom | 339/252 P |
| 1274621 | 5/1972 | United Kingdom | 339/183 |

*Primary Examiner*—Neil Abrams

*Attorney, Agent, or Firm*—Anthony J. Casella; Joseph A. Calvaruso

[57] ABSTRACT

An electrical programming assembly includes two or more printed circuit boards stacked one above another plus contact pins which connect the printed circuit boards at the various levels with one another. Each printed circuit board includes columns and rows of apertures which are disposed at precisely defined locations. Each aperture includes a metallic cladding around its rim. The contact pins connecting the various levels of the printed circuit boards generally include an elongated, nonconductive hollow shell member having a body portion and a probe portion for insertion into an aperture of the printed circuit board. The probe portion includes a plurality of spaced apart through slots. The contact pin further includes a plurality of conductive resilient contacts which are disposed within the probe member. Each contact is substantially diamond shaped in configuration having spaced apart corner members. The contacts are disposed at a predetermined angle relative to each other the angle being equal to or less than 90° but large enough to avoid electrical interference among the contacts. The corner members of the contact are received in and protrude through the through slots of the probe member and make contact with the metallic cladding of the printed circuit board apertures.

14 Claims, 6 Drawing Figures

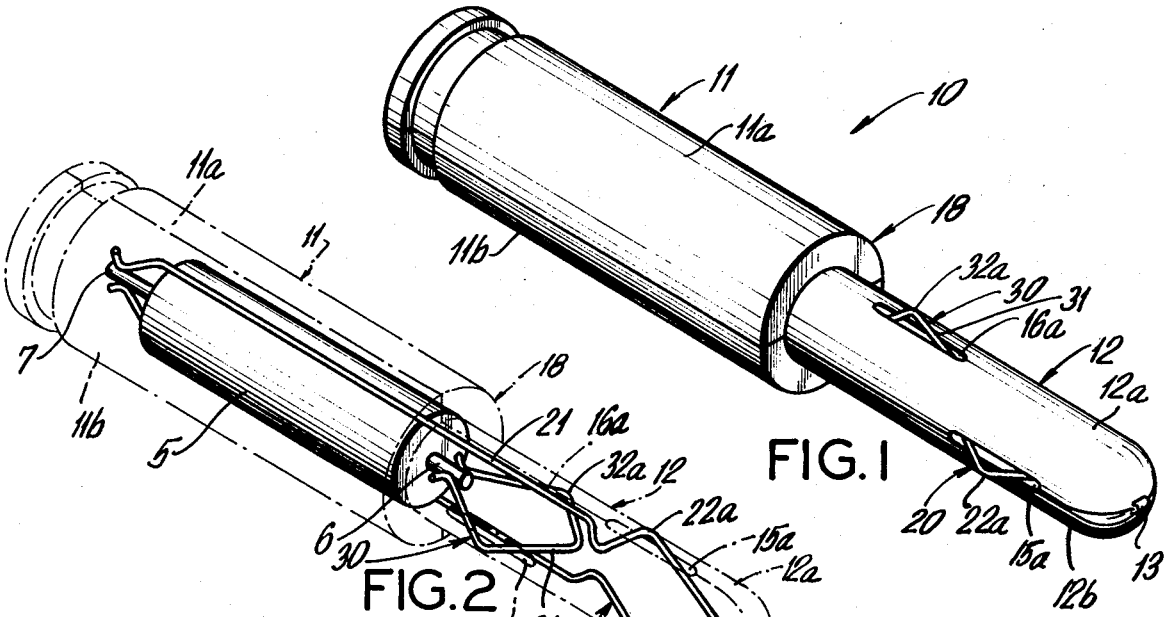
FIG.1
FIG.2
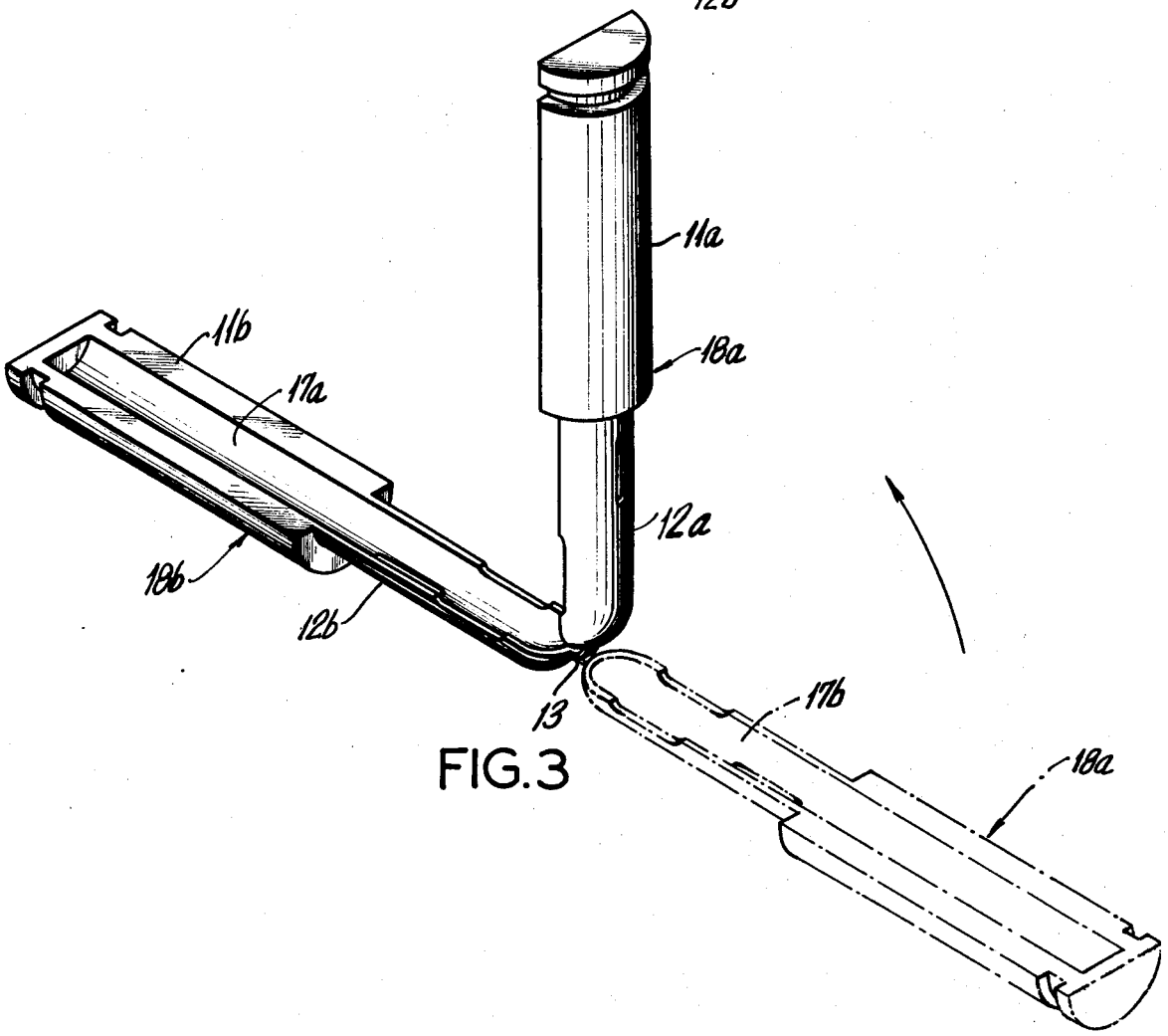
FIG.3

MULTI LEVEL PROGRAMMING ASSEMBLY

BACKGROUND OF THE INVENTION

The subject invention relates to a programming assembly for selectively interconnecting electrical circuit paths to control the function of electrical and/or electronic equipment. The subject assembly includes in combination a plurality of printed circuit boards which are stacked in a deck one above another in spaced apart relationship and contact pins which connect the printed circuit boards at the various levels with one another. The pins may either be shorting pins or they may contain components such as diodes, resistors, capacitors, lamps, etc. In known programming assemblies each of the printed circuit boards includes a plurality of columns and rows of apertures. In addition, each circuit board includes sets of spring socket contacts associated with the printed circuit board apertures, the contacts of one printed circuit board being disposed along the rows of apertures, the contacts of the adjacent printed circuit board being disposed along the columns of apertures thereof such that the strips of contacts of the respective boards intercept each other in an orthogonal relationship. As a result, the contacts of the respective columns and rows are aligned in pairs one above the other at the positions of intersection of the columns and rows. At least one of the sockets of each pair is formed as a thruway whereby selected socket contacts of one set may be electrically connected with the socket contacts of the other set which are aligned therewith by the insertion of connecting pins through the socket contacts having thruways into the socket contacts aligned therewith. Generally, the contacts in each column or row are electrically connected together and have a common means of connection to an external circuit. With such an arrangement the insertion of a connecting pin into a selected pair of sockets provides an electrical connection between two external circuits to which the respective column and row are connected.

In practice, it has been found that known programming assemblies have several shortcomings. For example, the socket contacts of the respective printed circuit boards protrude from the printed circuit boards in an opposed relationship, and thus, the boards must be sufficiently spaced from one another to prevent the contacts of each from touching one another. It will be appreciated that such space requirements are inconsistent with the industry's desire to increase component density per unit space. It will also be appreciated that a programming assembly in which the contacts are fixed parts of the printed circuit boards limits the programming flexibility of the assembly.

Accordingly, it is an object of the subject invention to provide a programming assembly which is simple and inexpensive to manufacture and use, and which allows for less space in between levels of printed circuit boards then heretofor known assemblies.

It is another object of the subject invention to provide a programming assembly having the above described characteristics in which the contacts are not fixed portions of the printed circuit boards but rather a part of the respective connecting pins.

It is a further object of the subject invention to provide a programming assembly having the above characteristics in which the electrical contact to and among the printed circuit boards is a function solely of the spring temper and spring retention of the contact pin rather than that of a spring contact fixedly connected to the printed circuit boards.

It is another object of the subject invention to provide a programming assembly as described above having greater flexibility than heretofor known assemblies such that programs may be easily changed by merely changing the position of the contact pins.

It is a further object of the subject invention to provide a novel contact pin for use in the above described programming assembly.

SUMMARY OF THE INVENTION

In accordance with the subject invention a programming assembly comprises in combination a plurality of printed circuit boards which are disposed one above the other in spaced apart relationship, and a contact pin for connecting the various levels of the printed circuit boards with one another. The printed circuit boards include a plurality of apertures arranged in columns and rows, the columns and rows of one printed circuit board being aligned with the columns and rows of the other printed circuit boards. Each aperture is surrounded with a conductive cladding. The assembly further includes means for rigidly holding the printed circuit boards one above another in a spaced apart relationship such that the apertures of each circuit board are aligned. Preferably, the apertures of each printed circuit board also includes an additional conductive plating disposed over the cladding and protruding within the aperture forming an annular lip therein.

The contact pin for electrically connecting the printed circuit board levels includes an elongated shell member which is formed from a nonconductive material. The shell is generally cylindrical in configuration and has a body portion and a reduced diameter probe portion. The probe portion has a plurality of spaced apart through slots. The contact pin further includes a plurality of conductive contacts each of which is preferably formed from a resilient wire member. The contacts are generally diamond shaped in configuration having spaced apart corner members. The contacts are disposed within the probe member of the shell at a predetermined angle relative to each other, the angle being equal to or less than 90° but large enough to avoid electrical interference among the contacts. The corner members of each of the contacts are received in and protrude through the through slots of the probe member. Thus, when the contact pin is inserted in the apertures of the printed circuit board the corners of the contacts protruding through the probe slots come into contact with the conductive cladding of the printed circuit board apertures, thus, effecting the desired electrical connection.

BRIEF DESCRIPTION OF THE DRAWINGS

FIG. 1 is a perspective view of the contact pin of the subject invention.

FIG. 2 is a perspective phantom view of the contact pin of the subject invention showing its interior structure.

FIG. 3 is a perspective view of the shell member of the subject contact pin.

DETAILED DESCRIPTION OF THE PREFERRED EMBODIMENTS

Figure 4:
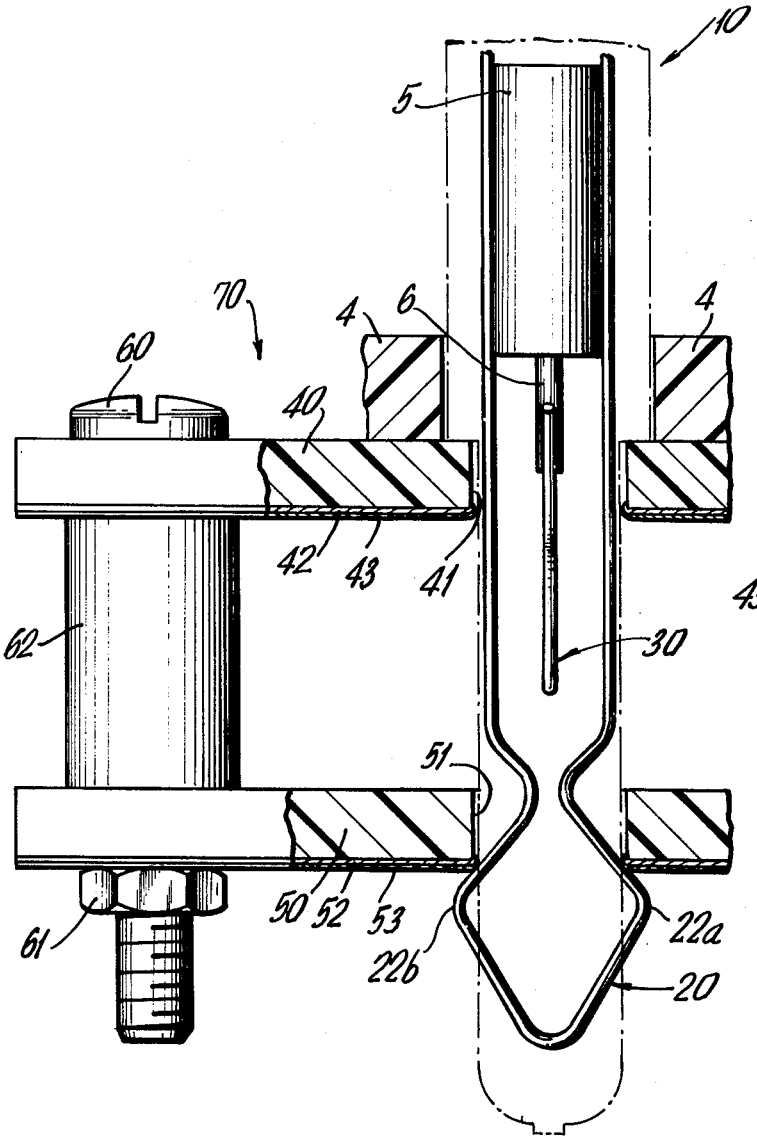
FIG. 4 is an elevational view, sectioned in part, of the programming assembly of the subject invention in which two levels of printed circuit boards have been connected by a contact pin.
Figure 5:
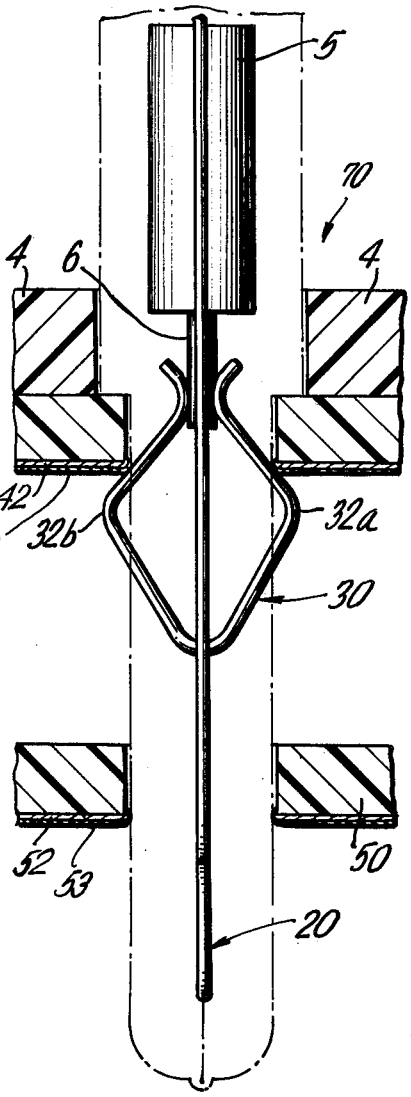
FIG. 5 is an elevational view, sectioned in part, of the subject assembly which has been rotated 90° with respect to FIG. 4.

Referring generally to FIGS. 1–6 the contact pin and programming assembly of the subject invention are designated generally by reference numerals 10 and 70, respectively. The subject pin is for use in electrically connecting a plurality of printed circuit boards which are stacked in a multi-level relationship to form a programming assembly. Each printed circuit board includes a plurality of columns and rows of apertures for receiving contact pins, the apertures of one printed circuit board being aligned with those of the other boards in the other levels of the assembly. FIGS. 4–5 illustrate a two level programming assembly, the levels of which are electrically connected by a two contact the pin being illustrated in detail in FIGS. 1–3. It will be understood however, that the subject invention also relates to programming assemblies having more than two levels, said assemblies, of course, being connected by a pin having more than two contacts.

Referring to FIGS. 1–3 the contact pin 10 of the subject invention includes an elongated hollow shell member 18 which is formed from a nonconductive material such as, for example, polypropylene or another suitable plastic. Shell member 18, which may typically be generally cylindrical in configuration, comprises a body portion 11 and a reduced diameter probe portion 12. Probe portion 12 is receivable in the printed circuit apertures for electrically connecting the various levels of the programming assembly 70. See FIGS. 4 and 5. Accordingly, the outer diameter of probe 12 must be less than the diameter of the printed circuit board apertures.

Further referring to FIGS. 1–3 the probe portion 12 of the subject pin includes pairs of opposed through slots, namely 15*a* and 15*b*, and 16*a* and 16*b*. The function of these slots will be described below.

Preferably, shell 18 is molded into two mirror image halves 18*a* and 18*b* which are hingedly connected by an integral hinge member 13. Thus, as illustrated in the figures, body portion 11 comprises two halves 11*a* and 11*b*, and probe portion 12 comprises two halves 12*a* and 12*b*. Referring to FIG. 3 it will be noted that each half of shell 18 includes a channel 17*a* and 17*b*, respectively, for accommodating contacts and other components within the pin. More particularly, referring to FIGS. 2, 4 and 5 the subject pin 10 further includes a plurality of resilient contacts which are disposed within hollow shell 18. As illustrated in the figures, pin 10 includes a pair of conductive resilient contacts 20 and 30 which are substantially diamond shape in configuration each having spaced apart corner members 22*a* and 22*b*, and 16*a* and 16*b*, respectively. Preferably, the contacts are each formed fron a single, resilient, conductive wire 21 and 31, respectively. Typically, the wire may be a hardened beryllium copper. As shown in the figures, contacts 20 and 30 are disposed in probe portion 12 of the contact pin such that corner members 22*a* and 22*b* are received in and protrude through opposed slots 15*a* and 15*b*. Similarly, corner members 32*a* and 32*b* of contact 30 are received in and protrude through probe slots 16*a* and 16*b*, respectively. Thus, it will be understood that when probe member 12 is inserted into the programming assembly 70 (see FIGS. 4 and 5) the electrical connection between the pin 10 and the printed circuit boards of the assembly is made by the corner member of the contacts which protrude through the probe member slots.

In accordance with the subject invention, it is necessary that the respective contacts within pin 10 do not make contact with one another. Accordingly, the contacts must be spaced from one another. As illustrated in the figures this is effected by disposing the contacts within the pin at a predetermined angle relative to one another. In the two contact pins illustrated in the figures contacts 20 and 30 are preferably disposed at a 90° angle relative to one another thus, providing the contacts with the maximum space between them. Of course, the contacts may be disposed relative to one another at an angle less than 90° provided they remain non-touching. Similarly, where there are more than two contacts within the subject pin the contacts will be separated by an angle less than 90° but large enough to avoid electrical interference when the pin is inserted into the programming assembly. It should be noted that where there are more than two contacts within pin 10, there must be additional pairs of slots in the probe portion 12 to receive the corner members of the contacts. It will be appreciated that the opposed pairs of slots in probe portion 12 are disposed relative to one another in accordance with the angular relationship between their respective contacts.

Further referring to FIG. 2 the contact pin of the subject invention includes a component 5 which is disposed in the body portion 11. Component 5 may be a shorting component or another component such as a diode, resistor, capacitor etc. Typically, component 5 has a pair of terminals 6 and 7, which as illustrated in the figures, are suitably connected to contacts 30 and 20, respectively.

Figure 6:
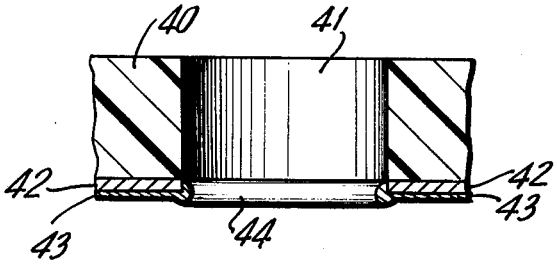
FIG. 6 is an enlarged sectional view of an aperture of a printed circuit board showing the metallic cladding and plating thereof before a contact pin has been inserted therein.

Referring to FIGS. 4–6 the programming assembly 70 of the subject invention employing a two contact component pin connecting an assembly having two printed circuit board levels, includes a plurality of printed circuit boards, namely, 40 and 50, which are disposed one above the other in spaced apart relationship, and kept in that position by means of peg 62, screw 60 and nut 61. A cover plate 4 is also included on the top of board 40. As indicated above, while the figures illustrate only a two level assembly, the subject invention also relates to assemblies having more than two levels.

Further referring to FIGS. 4–6 the printed circuit boards 40 and 50 include columns and rows of apertures for receiving the contact pin, the apertures being disposed at precisely defined locations in order to form the programming matrix of the system. Specifically referring to printed circuit board 40, there are included a plurality of apertures 41 which preferably have a diameter substantially similar to the outer diameter of probe member 12 of the contact pin. A metallic cladding, for example, of copper, surrounds the rim of apertures 41 on the undersurface of the printed circuit board. The copper cladding may be of varying thickness depending on current density requirements. In addition, it is preferable that an additional metallic plating 43 be added over the cladding 42 to form an annular lip 44 within aperture 41. As will be described below this added plating provides the subject assembly with increased reliability and greater wear resistance. Similarly, apertures 51 of board 50 are provided with a metallic cladding 52 and additional plating 53.

Typically, the apertures 41 constituting the columns on board 40 will be connected to each other and to an external circuit. Similarly, the apertures 51 which constitute the columns of board 50 will be connected to each other and to another external circuit. Electrical connection of the external circuits is effected by insertion of contact pin 10 into the aligned apertures 41 and 51, of printed circuit boards 40 and 50, respectively, the corner members of contacts 20 and 30 touching the conductive cladding (42 and 52) and plating (43 and 53) of the board (40 and 50). It will be noted that while the corner members of each contact are separated by a distance greater than the diameter of the printed circuit board apertures the resiliency of the wire from which the contacts are formed enables the corner members to be compressed inwardly as the contact pin is inserted into the apertures. When the contact is completely pushed through the aperture, the corner members spring back to their original configuration.

As indicated above, it is preferable that the printed circuit boards include, in addition to a metallic cladding around its apertures, a metallic plating over the cladding and forming an annular lip within the aperture. FIG. 6 illustrates a typical aperture 41 having cladding 42 and plating 43, the aperture being shown before it has been exposed to insertions by a contact pin. Referring to FIGS. 4 and 5 the apertures are shown after they have been exposed to pin insertions. It will be noted that the in and out action of the pin has caused the plating lips 44 and 54 to curve inwardly against the inner wall of their respective apertures. Thus, the contacts 20 and 30 make an electrical connection not only with the undersurface of the printed circuit boards but also with the inner walls of their respective apertures. This feature helps to improve the reliability and wear resistance of the assembly.

In summary, the subject invention provides a new multilevel programming assembly, and a new contact pin for electrically connecting the various levels of the assembly. The subject assembly and pin, while quite simple in construction, and relatively inexpensive to manufacture, provides a system which is quite reliable, and has increased flexibility over the prior art. Unlike known assemblies and pins, the electrical contact to and among the various levels of the subject assembly is a function solely of the spring temper and spring retention of the contact pin rather than that of a spring contact fixedly connected to the printed circuit boards of the assembly. In addition, the particular construction of the subject assembly and pin enables the subject assembly to be more compact than known assemblies.

While the preferred embodiment of the subject invention has been described and illustrated, it would be obvious that various changes and modifications can be made therein without departing from the spirit of the invention which should be limited only by the scope of the appended claims.

What is claimed is:

1. A contact pin for connecting a plurality of printed circuit boards in a spaced apart multi-level relationship, said printed circuit board having a plurality of columns and rows of apertures, said contact pin comprising:

an elongated hollow shell member, formed from a nonconductive material having a body portion and a probe portion for insertion into an aperture of a printed circuit board, said probe portion including a plurality of spaced apart through slots; and a plurality of conductive, resilient contacts disposed within said shell member, each contact being substantially diamond shaped in configuration, having spaced apart corner members, said corner members of each contact being on opposite edges of said diamond configuration, said contacts being disposed at a predetermined angle relative to each other, said angle being equal to or less than 90°, but large enough to avoid electrical interference among said contacts, the corner members on opposite edges of each said contact being received in and protruding through the through slots of the probe portion.

2. A contact pin as recited in claim 1 in which the shell member is substantially cylindrical in configuration.

3. A contact pin as recited in claim 1 in which the probe portion has a diameter less than the diameter of the body portion.

4. A contact pin as recited in claim 1 in which the elongated shell member is formed from a pair of hingedly connected members.

5. A contact pin as recited in claim 1 in which the contacts are connected to an electrical component disposed within the body portion of the pin.

6. A contact pin as recited in claim 1 in which each contact is formed from an integral resilient wire member.

7. A contact pin for connecting a plurality of printed circuit boards in a spaced apart multilevel relationship, said printed circuit board having a plurality of columns and rows of apertures, said contact pin comprising:

an elongated hollow shell member, formed from a nonconductive material, said shell member being generally cylindrical in configuration, having a body portion and a reduced diameter probe portion for insertion into an aperture of a printed circuit board, said probe portion including a plurality of spaced apart through slots; and a plurality of conductive, resilient contacts disposed within said probe portion, each contact being substantially diamond shaped in configuration, having spaced apart corner members, said corner members of each contact member being on opposite edges of said diamond configuration, each of said contacts being formed from an integral wire member, said contacts being disposed at a predetermined angle relative to each other, said angle being equal to or less than 90°, but large enough to avoid electrical interference among said contacts, the corner members on opposite edges of each said contact being received in and protruding through the through slots of the probe portion for making an electrical connection with the printed circuit boards.

8. A multilevel electrical assembly comprising in combination:

a plurality of printed circuit boards, said printed circuit boards being disposed one above the other in spaced apart relationship, each of said printed circuit boards including the plurality of apertures arranged in columns and rows, the columns and rows of one printed circuit board corresponding to the columns and rows of the other printed circuit boards;

a conductive cladding surrounding the apertures of the printed circuit boards, the cladding being disposed on the undersurface of the printed circuit boards;

means for rigidly holding the printed circuit boards one above another such that the respective apertures of each are aligned; and a contact pin for electrically connecting the respective printed circuit boards, said contact pin including an elongated hollow shell member formed from a nonconductive material, said shell member having a body portion and a reduced diameter probe portion, said probe portion including a plurality of spaced apart through slots, said contact pin further including a plurality of conductive contacts disposed within the shell, said contacts being generally diamond shaped in configuration having spaced apart corner members, said corner members of each contact member being on opposite edges of said diamond configuration, said contacts being disposed at a predetermined angle relative to each other, said angle being equal to or less than 90° but large enough to avoid electrical interference among the respective contacts, the corner members on opposite edges of each of said contacts being received in and protruding through the through slots of the probe member, the probe member being receivable in the apertures of the printed circuit boards with the corner portions of each contact making electrical contact with a different printed circuit board.

9. A multilevel electrical assembly as recited in claim 8 in which there is a conductive plating disposed over the conductive cladding, said plating forming an annular lip within each printed circuit board aperture.

10. A multilevel electrical assembly as recited in claim 8 in which the shell member of the contact pin is substantially cylindrical in configuration.

11. A multilevel electrical assembly as recited in claim 8 in which the probe portion of the contact pin has a smaller diameter than the body portion.

12. A multilevel electrical assembly as recited in claim 8 in which each contact of the contact pin is formed from an integral, resilient wire member.

13. A multilevel electrical assembly as recited in claim 8 in which the contacts of the contact pin are connected to an electrical component disposed within the body portion of the pin.

14. A multilevel electrical assembly as recited in claim 8 in which the apertures forming the columns of one of the printed circuit boards are electrically connected to each other and to a first external circuit, and the apertures forming the rows of another of the printed circuit boards are electrically connected to each other and to a second external circuit whereby the external circuits are connected when the contact pin is inserted into the printed circuit apertures.

* * * * *